US009422090B2

(12) United States Patent
Leung et al.

(10) Patent No.: US 9,422,090 B2
(45) Date of Patent: Aug. 23, 2016

(54) EXTRUDED TUBE SPRING FOR CONTAINER AND PACKAGING APPLICATIONS

(71) Applicants: Valentin Leung, Tsuen Wan (HK); John Violett, Tsuen Wan (HK)

(72) Inventors: Valentin Leung, Tsuen Wan (HK); John Violett, Tsuen Wan (HK)

(73) Assignee: Global Dispensing Ltd, Hong Kong (HK)

( * ) Notice: Subject to any disclaimer, the term of this patent is extended or adjusted under 35 U.S.C. 154(b) by 352 days.

(21) Appl. No.: 13/969,495

(22) Filed: Aug. 16, 2013

(65) Prior Publication Data

US 2014/0048992 A1 Feb. 20, 2014

Related U.S. Application Data

(60) Provisional application No. 61/683,751, filed on Aug. 16, 2012.

(51) Int. Cl.

*B65D 43/16* (2006.01)
*B65D 43/26* (2006.01)
*B65D 43/22* (2006.01)

(52) U.S. Cl.

CPC ..... *B65D 43/26* (2013.01); *B65D 43/166* (2013.01)

(58) Field of Classification Search

CPC .... B65D 43/16; B65D 43/296; B65D 47/08; B65D 83/0805; B65D 2251/1058; B65D 43/26; B65D 43/166

USPC ..... 220/264, 833, 835, 829, 229, 326, 827, 220/845; 267/164

See application file for complete search history.

(56) References Cited

U.S. PATENT DOCUMENTS 5,699,912 A * 12/1997 Ishikawa ..... A47K 10/421 206/494
2004/0159661 A1* 8/2004 Aochi ..... B65D 25/2811 220/264
2005/0023284 A1* 2/2005 Heiberg ..... B65D 43/164 220/827
2008/0179326 A1* 7/2008 Krauth ..... B65D 83/0805 220/260
2012/0312832 A1* 12/2012 Lane ..... B65D 47/066 220/833

* cited by examiner

*Primary Examiner* — J. Gregory Pickett
*Assistant Examiner* — Niki M Eloshway
(74) *Attorney, Agent, or Firm* — White-Welker & Welker, LLC; Matthew T. Welker, Esq.

(57) ABSTRACT

A silicone extruded tubular spring that has the possibility to be folded around an axis perpendicular to its own axis of extrusion, thus creating the compression and release as of a spring. The base has a reach-in hole on its body to allow the user to reach through. The lid is the base's capping object; it is designed to cover the reach-in hole of the base. It should be designed in a way to limit the area of the remaining gaps of the base's reach-in hole. The extruded tubular spring can store and release energy in order to displace the lid. It can be of any material that provides the appropriate stiffness to activate the lid. The retention latch is the user interface on which he acts in order to have the lid pop-up.

17 Claims, 12 Drawing Sheets

EXTRUDED TUBE SPRING FOR CONTAINER AND PACKAGING APPLICATIONS

CROSS REFERENCE TO RELATED APPLICATIONS

This application claims priority from U.S. patent application Ser. No. 61/683,751, entitled "System and Method for Urban Mapping and Positioning", filed on 16-Aug.-2012. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to container lids. More specifically, the present invention relates to self-opening, reclosable lids for use with a container or packaging device or other such apparatus.

BACKGROUND OF THE INVENTION

In the packaging industry, around reach-in areas, manufacturers are using springs to create pop-up lids or cover activated closures. They need to have a device that is able to create a force to move the lid when the end-user is activating the opening device. The device also needs to be simple in shape and inexpensive enough in order to provide an easy integration, a low cost of goods, and a low scrap material rate in the manufacturing process.

Therefore, what is needed is a silicone extruded tubular spring, which is a device that has the possibility to be folded around an axis perpendicular to its axis of extrusion, thus creating the compression and release like a spring. The fact that it is an extruded tubular shape means there is virtually no material scrap rate.

Current silicone springs need to be shaped in different forms, the most common is the T-form. The T-form is already performing the spring function very well, but it is more complex to manufacture as it needs to be punched through a sheet of silicone, and subsequently, the manufacturing process produces a large amount of web (scrap from the punching process). What is needed is a silicone spring product that can be produced quickly and results in less manufacturing process scrap. The spring of the present invention provides this solution as a manufacturer only needs to cut the spring at the right length during the manufacturing process, which results in no scrap.

SUMMARY OF THE INVENTION

The present invention is a silicone extruded tubular spring that has the possibility to be folded around an axis perpendicular to its own axis of extrusion, thus creating the compression and release like a spring.

In one embodiment, a reach-in device is designed to let a user interact with the silicone extruded tubular spring component to open and close a lid. This application provides a degree of air sealing that allows the lid to effectively separate two environments, above and below itself.

The base body of the device of this embodiment is made of any hard material including but not limited to plastic. The base has a reach-in hole on its body to allow the user to reach through.

The lid is the base's capping object, it is designed to cover the reach-in hole of the base. It can be of any size but in the best case, should be designed in a way to limit the area of the remaining gaps of the base's reach-in hole. The lid is made of any hard material including but not limited to plastic.

The extruded tubular spring can store and release energy in order to displace the lid. It can be of any material that provides the appropriate stiffness to activate the lid.

The retention latch is the user interface used to make the lid pop-up. It is a part of the cover or can be an additional part assembled to the cover by means of fasteners.

BRIEF DESCRIPTION OF THE DRAWINGS

The accompanying drawings, which are incorporated herein form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

The Figures illustrate the embodiment of a silicone extruded tubular spring 100 that has the possibility to be folded around an axis 101 perpendicular to its own axis of extrusion 102, thus creating the compression and release as of a spring 100 used in a container 200.

Figure 2:
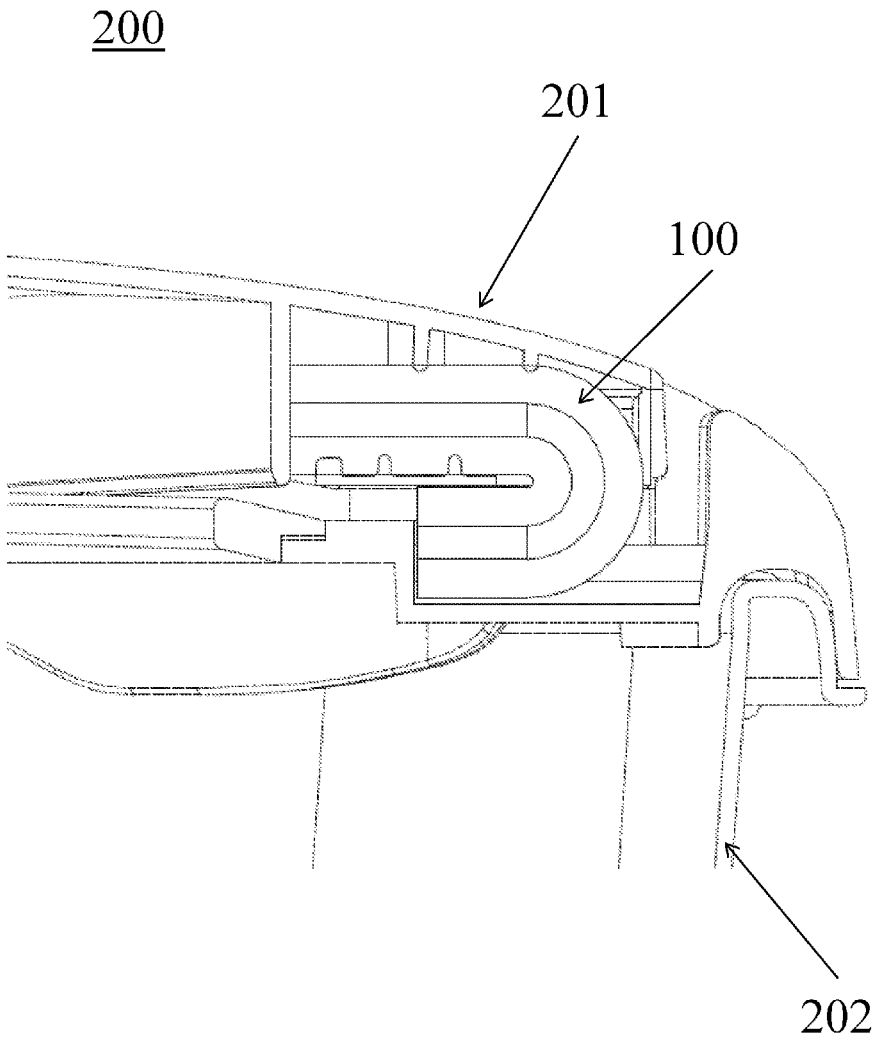
FIG. 2 is an illustration of the spring tube of the present invention as a component of a container in combination with a spring lid in a closed state as depicted in a CAD model.
Figure 3:
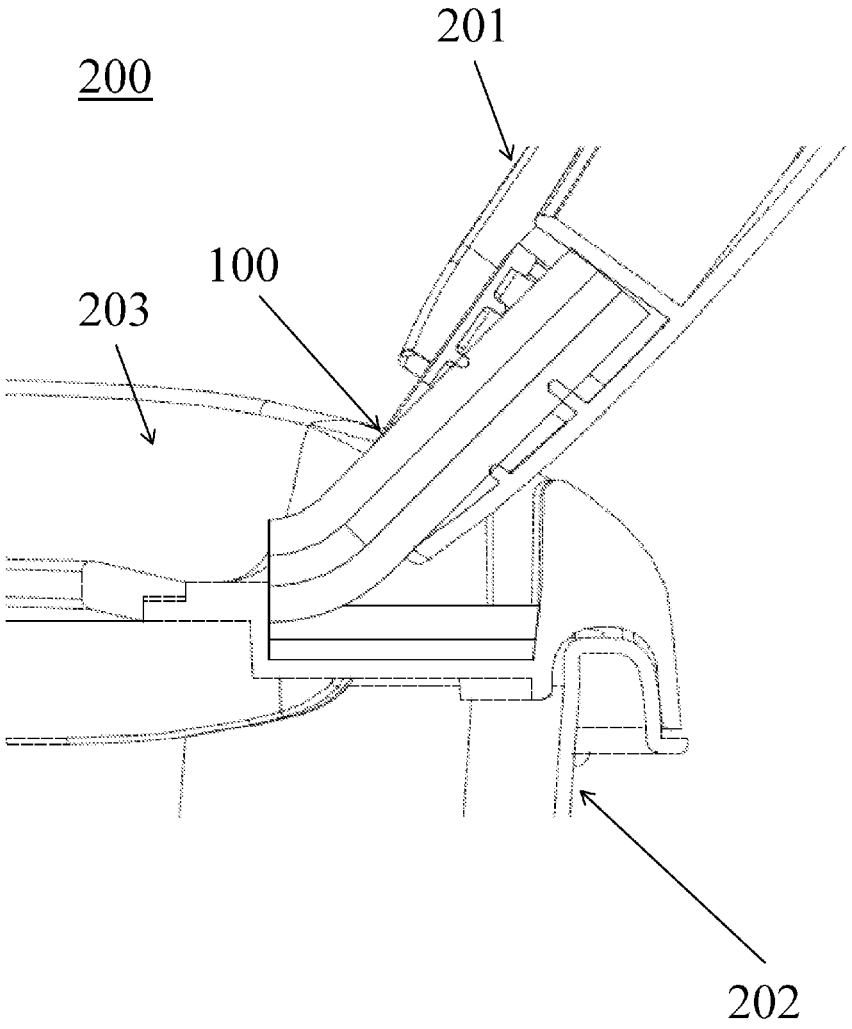
FIG. 3 is an illustration of the spring tube of the present invention as a component of a container in combination with a spring lid in an open state as depicted in a CAD model.
Figure 4:
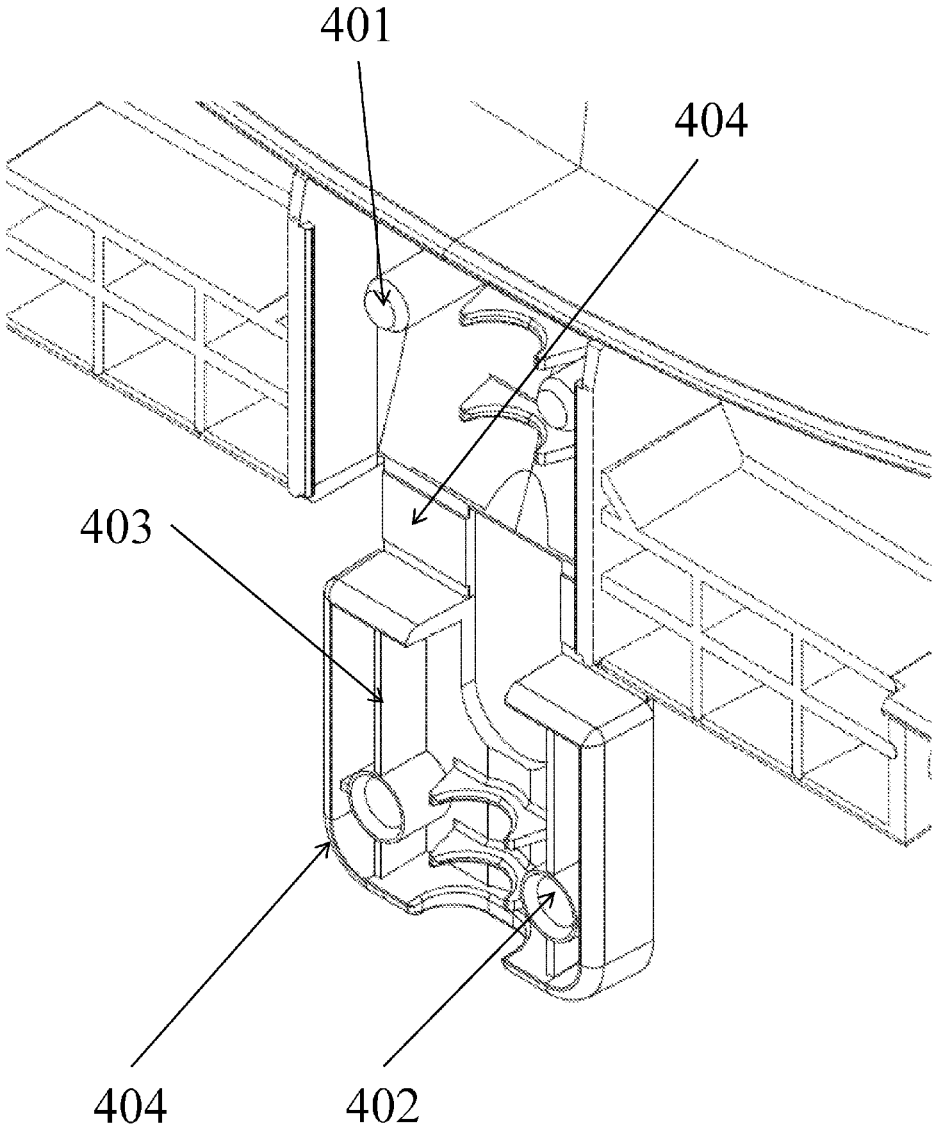
FIG. 4 is a photograph of a prototype product incorporating the spring clamping system.

The container device 200 shown in FIGS. 2-3 is a reach-in container device 200 that is designed to let a user interact with it to open and close a lid 201. It provides a degree of air sealing that allows the lid 201 to effectively separate two environments above and below itself.

The base body 202 is made of any hard material including but not limited to plastic. The base body 202 has a reach-in hole 203 on its body to allow the user to reach through.

Figure 10:
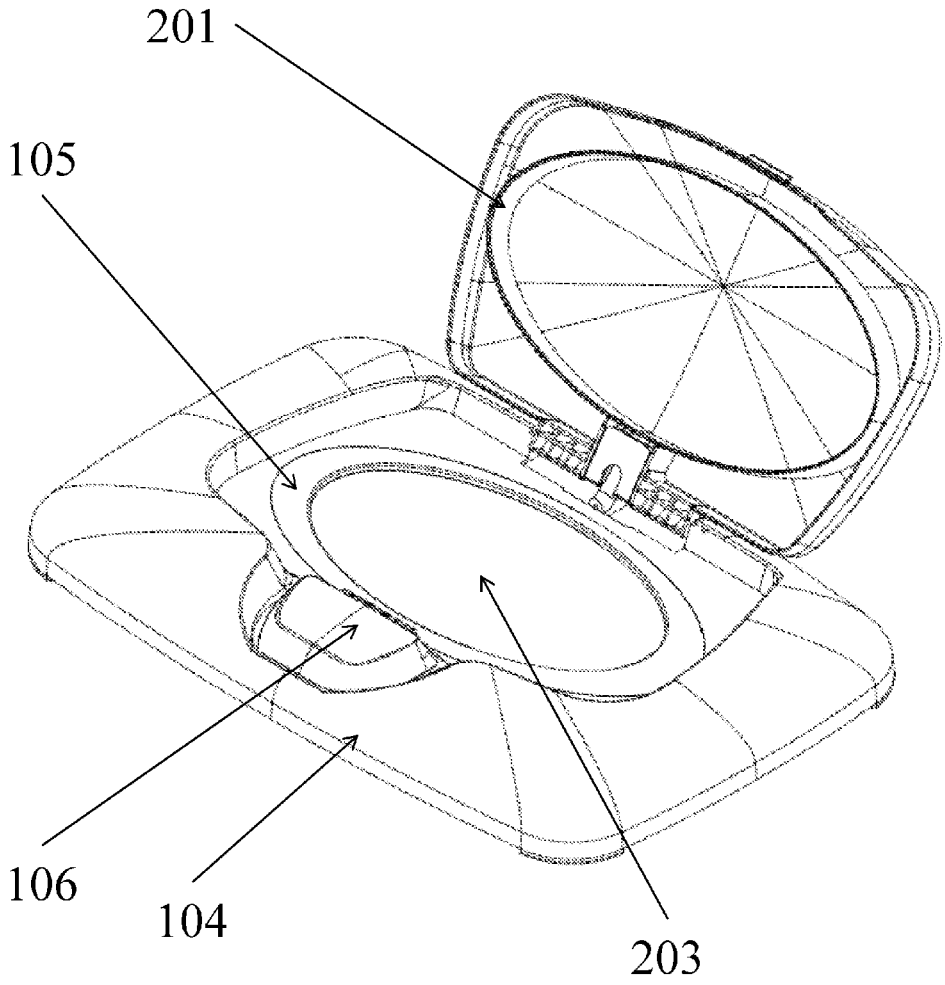
FIG. 10 is an illustration of the lid device of the present invention in a closed position on a base.

The lid 201, as shown in FIG. 10, is the base's capping object; it is designed to cover the reach-in hole 203 of the base body 202. It can be of any size, but in the best case it should be designed in a way to limit the area of the remaining gaps of the base's reach-in hole 203. The lid 201 is made of any hard material including but not limited to plastic.

Figure 1:
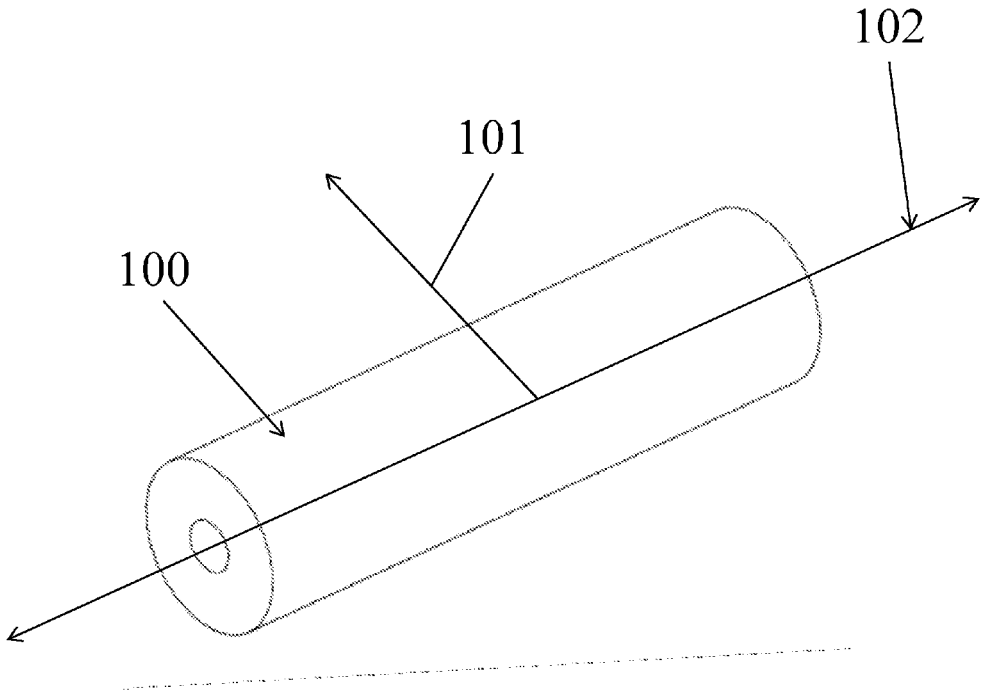
FIG. 1 is an illustration of the spring tube of the present invention in a normal state as depicted in a CAD model.

The extruded tubular spring 100, as shown in FIG. 1, is the device that can store and release energy in order to displace the lid 201. It can be of any material that provides the appropriate stiffness to activate the lid 201.

Referring to FIGS. 4-9, the spring tube 100 is secured by a lock system comprising a boss 401 and hole 402 to attach the spring tube 100 to the lid 201. The bosses 401 are located on the lid 201 and the corresponding holes 402 are located on a ribbed 403 tab 404 secured by a flexible plastic 404 flap on one side to the lid 201. When the tab 404 is folded toward the lid 201, the bosses 401 engage their corresponding holes 404 located on the tab 404 and secure the tab 404 in a closed position with respect to the lid 201. The ribs 403 secure the spring tube 100 in place when the tab 404 is in a closed position.

Figure 11:
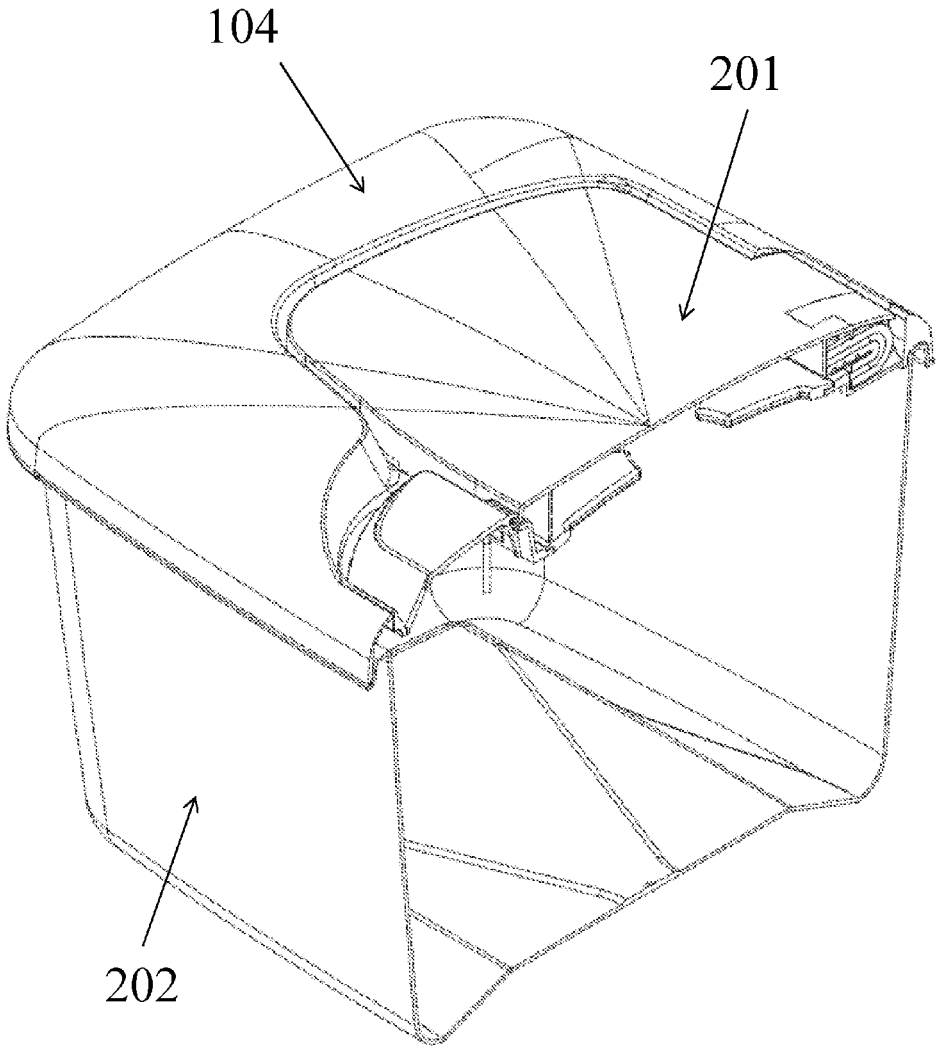
FIG. 11 is a sectional illustration of the latch of the lid device of the present invention in a closed position on a base.

The base retention latch 103 is the user interface used to make the lid 201 pop-up. It is a part of the cover 104 or can be an additional part assembled to the cover 104 by means of fasteners. Referring to FIG. 11, the lid 201, shown as the green part, seems to be interfering with the base 202, shown as the white part, in reality, the base retention latch 103 will deform and the lip 105 of the base retention latch 103 will engage in the groove 105 of the on the base side 106.

The base is connected to the lid by means of a physical bonding like a living hinge, or a snap fit providing the possibility of rotation like a post hinge or even with the help of extra fastener like a screw/bolt assembly.

The base retention latch 103 is a part of the base 202 or can be an additional part assembled to the cover 201 by means of fasteners. The extruded tubular spring 100 is connected to the lid 201 by means of snap-in features, glue, or fasteners.

Figure 5:
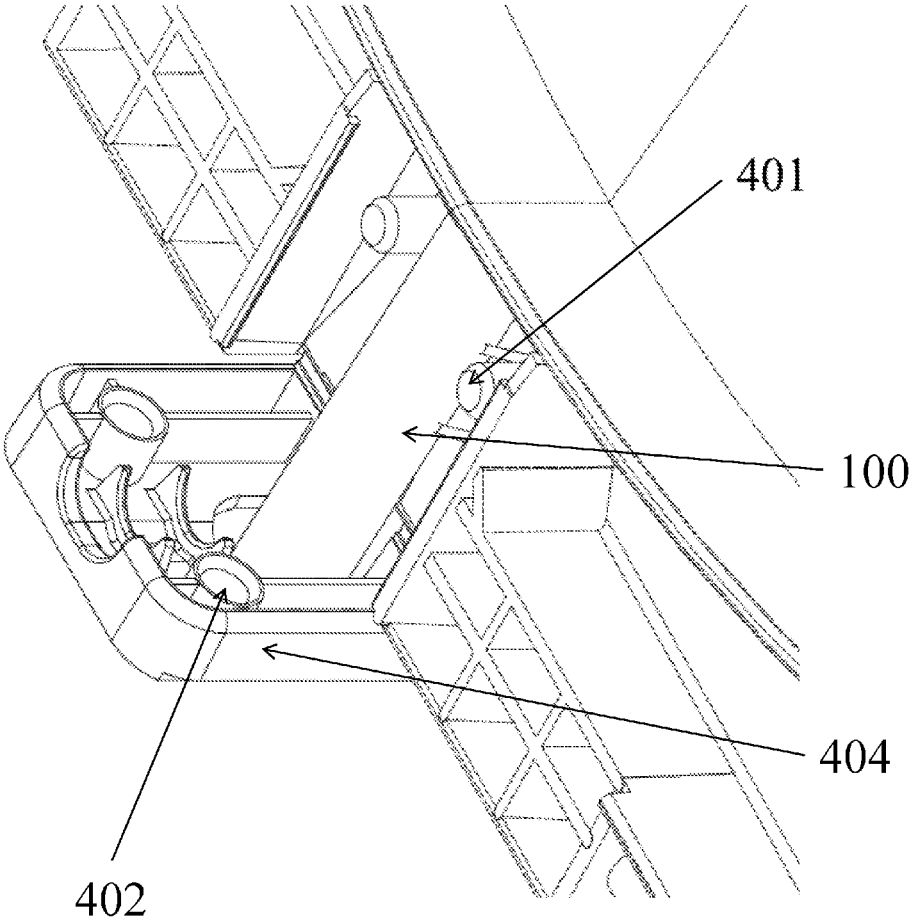
FIG. 5 is a photograph of a prototype product incorporating the spring clamping system used in combination with the spring tube and container where the spring tube is placed within the clamping mechanism and the clamping system is in an unlocked position.
Figure 6:
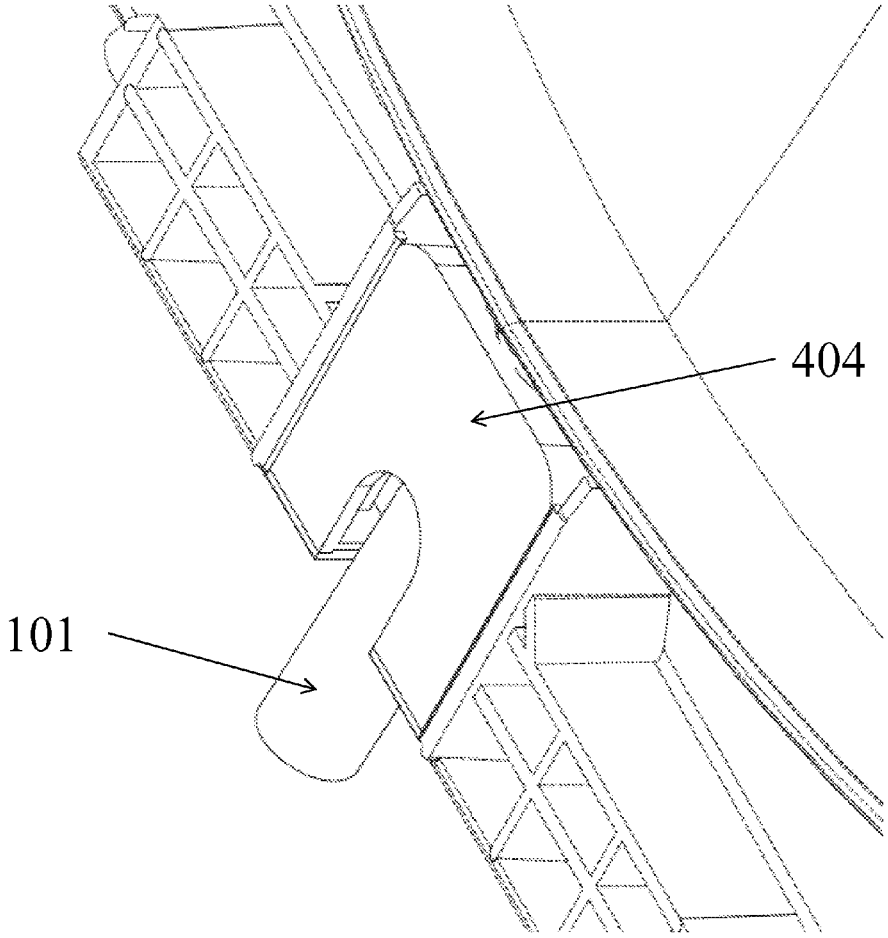
FIG. 6 is a photograph of a prototype product incorporating the spring clamping system used in combination with the spring tube and container where the clamping system is in a closed position.
Figure 7:
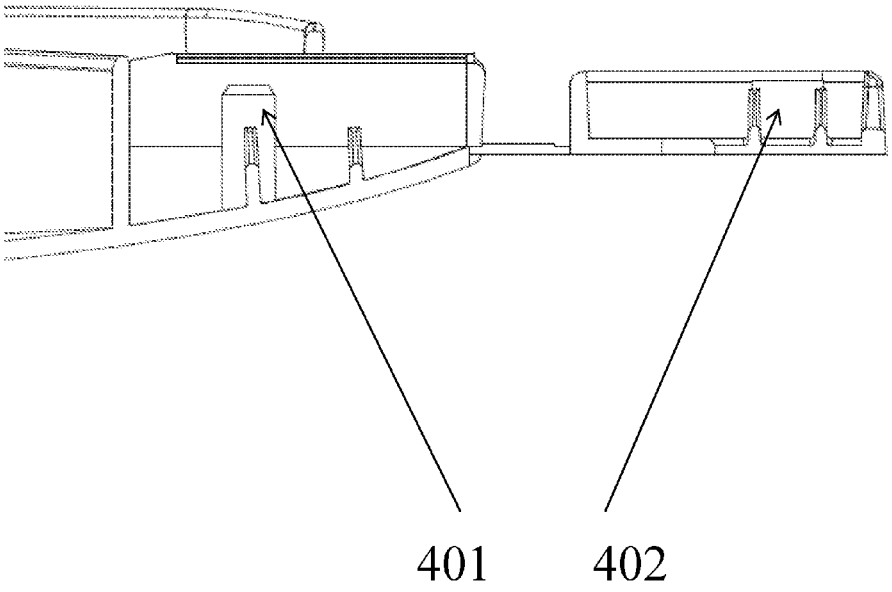
FIG. 7 is a photograph of a prototype product showing a sectional view of the spring clamping mechanism in an unlocked position.
Figure 8:
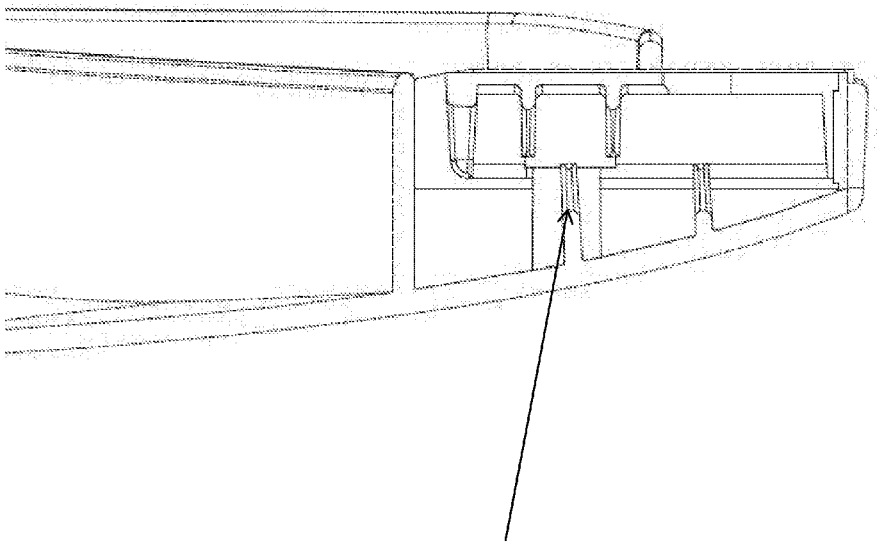
FIG. 8 is a photograph of a prototype product showing a sectional view of the spring clamping mechanism in a locked position.
Figure 9:
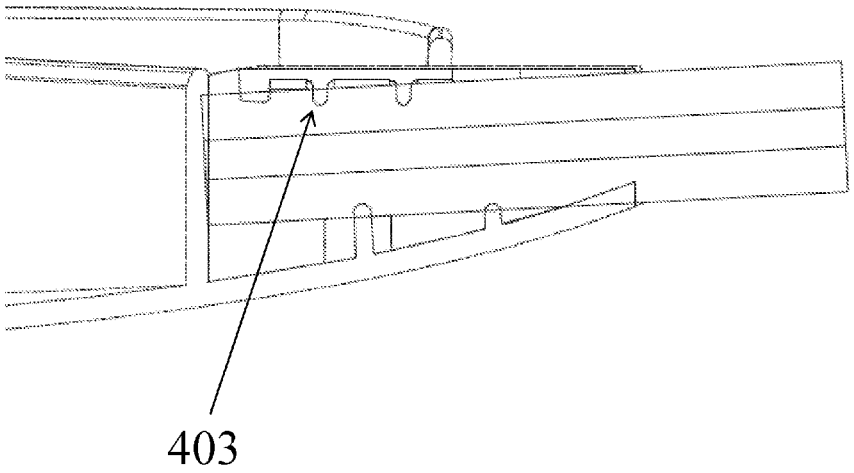
FIG. 9 is a photograph of a prototype product showing a sectional view of the spring clamping mechanism in a locked position with the boss engaged in the hole.

As shown in FIGS. 3, 5 and 6, when opened, the extruded tubular spring 100 is relaxed and in a non-folded position. As soon as the lid 201 starts to close, it will start to fold the extruded tubular spring 100 on itself, it will create and store potential energy as elastic energy as shown in FIG. 2. Once fully closed, the lid 201 will come in contact with the base retention latch 103 which will keep it in place through geometric features that ensure that the lid 201 moves back in the opening position or moves further down.

When the user presses on the base retention latch 103, it releases the lid 201; the force stored in the extruded tubular spring 100 pushes back the lid 201 and this opens all the way back allowing the user to access the content of the pop-up wet tissue container through the reach-in area 203.

Figure 12:
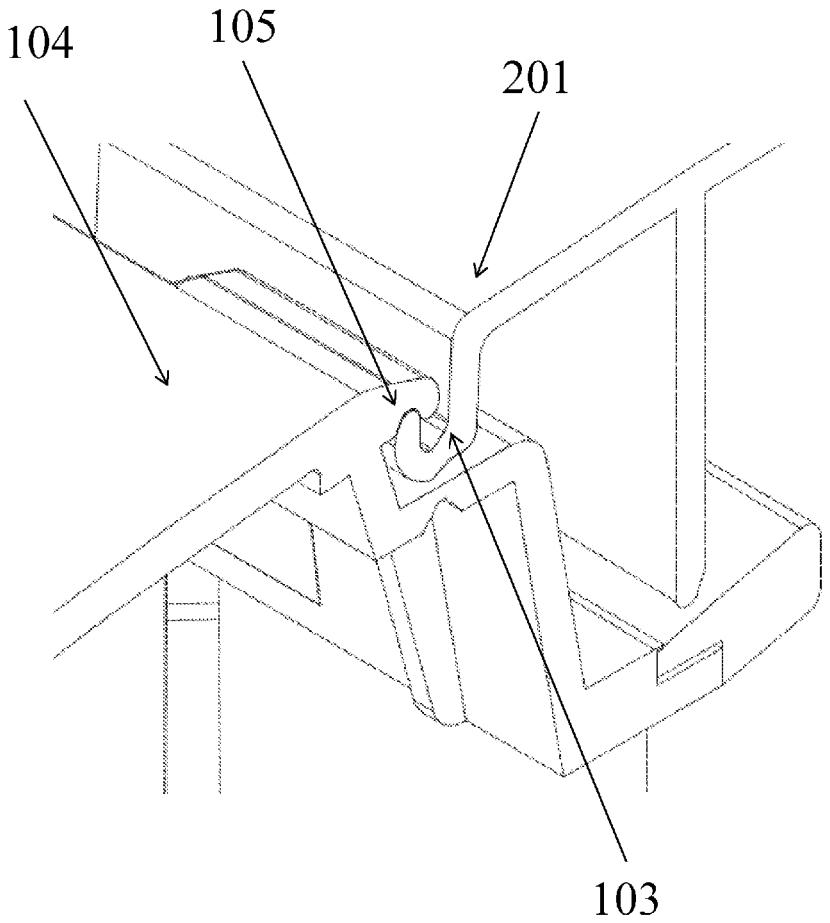
FIG. 12 is an illustration of the lid of the present invention provided with a flexible thermoplastic section, which gives the lid button a pop-up feedback.

Now referring to FIGS. 10-12, the cover 104, lid 201, retention latch 103, and extruded tubular spring 100 are necessary components for the device that must be used in combination for the present invention to properly function. The reach-in hole 203 shown in FIG. 10 can be improved by the usage of a soft thermoplastic zone to give a better user experience when dispensing wet tissues, this soft thermoplastic area can be used to give a spring behavior to the retention latch 103. The flexible thermoplastic 105 is shown as the blue part, which gives the button 106 a pop-up feedback.

The base 202, lid 201, and retention latch 103 are made from hard plastic to reduce manufacturing cost. The extruded tubular spring 100 is made from extruded silicone and cut at the right length, then all the components are assembled during the assembly process.

Shuffling is possible, the extruded tubular spring 100 can be attached to the base 202 and push on the lid 201. The extruded tubular spring 100 can also be attached to both base 202 and lid 201. In this embodiment, the base 202, cover 104, and retention latch 103 are made from hard plastic to reduce manufacturing costs. The extruded tubular spring 100 is made from extruded silicone and cut at the right length, then, all the components are assembled during the assembly process.

For operation, the end-user activates the retention latch 103 to have the lid 201 pop-up open. When opened, the user can push down the lid 201 to have it closed. In an alternative operation, the base 202, cover 104, and retention latch 103 are made from hard plastic to reduce manufacturing costs. The extruded tubular spring is made from extruded silicone and cut at the right length, then, all the components are assembled during the assembly process.

The present invention can be used as a means for producing an opening force in any container or packaging device. In a preferred embodiment, the present invention is glued on a soft pack container, containing wet tissues. In yet another embodiment, the base 202 can be turned into a cover 104 and integrate with a refillable wet tissue container.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. An extruded tube spring container comprising:

a silicone extruded tubular spring that is folded around an axis perpendicular to its own axis of extrusion, creating the compression and release as of a spring;

a base having a reach-in hole on a base body to allow a user to reach through;

a lid is the base's capping object, it is designed to cover the reach-in hole of the base;

the lid is designed to limit an area of remaining gaps of the base's reach-in hole;

the extruded tubular spring can store and release energy in order to displace the lid; and a retention latch that is a part of the lid or can be an additional part assembled to the lid by means of fasteners;

the extruded tubular spring is secured by a lock system comprising;

one or more bosses and corresponding holes to attach the extruded tubular spring to the lid;

the bosses are located on the lid;

the corresponding holes are located on a tab having ribs secured by a flexible plastic flap on one side to the lid;

when the tab is folded toward the lid, the bosses engage their corresponding holes located on the tab and secure the tab in a closed position with respect to the lid; and the ribs secure the extruded tubular spring in place when the tab is in a closed position.

2. The extruded tube spring container of claim 1, wherein the retention latch is the user interface on which the user acts in order to have the lid pop-up.

3. The extruded tube spring container of claim 1, wherein the extruded tubular spring is made of a material that provides the appropriate stiffness to activate the lid.

4. The extruded tube spring container of claim 1, wherein the lid provides a degree of air sealing that allows the lid to effectively separate an environment above the lid from an environment below the lid.

5. The extruded tube spring container of claim 1, wherein the retention latch is the user interface used to make the lid pop-up.

6. The extruded tube spring container of claim 1, wherein the retention latch is a part of the lid.

7. The extruded tube spring container of claim 1, wherein the retention latch is an additional part assembled to the lid by means of fasteners.

8. The extruded tube spring container of claim 1, wherein the retention latch will deform and a lip of the retention latch will engage in a groove on a side of the base.

9. The extruded tube spring container of claim 1, wherein the base is connected to the lid by means of a physical bonding.

10. The extruded tube spring container of claim 1, wherein the base is connected to the lid by a snap fit providing the possibility of rotation.

11. The extruded tube spring container of claim 1, wherein the base is connected to the lid by a snap fit providing the possibility of rotation with the help of a screw/bolt assembly.

12. The extruded tube spring container of claim 1, wherein the retention latch is a part of the base.

13. The extruded tube spring container of claim 1, wherein the extruded tubular spring is connected to the lid by means of snap-in features, glue, or fasteners.

14. The extruded tube spring container of claim 1, wherein when the user presses on the retention latch, the force stored in the extruded tubular spring pushes back the lid which opens all the way back allowing the user to access content of the container through the reach-in hole.

15. The extruded tube spring container of claim 1, wherein the reach-in hole further comprises a soft thermoplastic zone, the thermoplastic zone can be used to give a spring behavior to the retention latch.

16. The extruded tube spring container of claim 1, wherein the extruded tubular spring is attached to the base and the lid.

17. The extruded tube spring container of claim 1, wherein the base, lid, and retention latch are made from hard plastic; and the extruded tubular spring is made from extruded silicone.

* * * * *